US010669655B2

(12) United States Patent
Hilton et al.

(10) Patent No.: US 10,669,655 B2
(45) Date of Patent: Jun. 2, 2020

(54) SEAMLESS KNIT ENCLOSURE FOR HEADPHONES

(71) Applicant: SR HoMedics, LLC, Commerce Township, MI (US)

(72) Inventors: Elizabeth Hilton, Holland, MI (US); Brett Harrison Newman, San Francisco, CA (US); Kyle Swen, San Carlos, CA (US); John O. Mikkola, Commerce Township, MI (US); David Yang, Farmington Hills, MI (US); Joshua Brent Poulsen, Salt Lake City, UT (US); Sean Missal, San Francisco, CA (US)

(73) Assignee: SR HoMedics, LLC, Commerce Township, MI (US)

( * ) Notice: Subject to any disclaimer, the term of this patent is extended or adjusted under 35 U.S.C. 154(b) by 194 days.

(21) Appl. No.: 15/891,033

(22) Filed: Feb. 7, 2018

(65) Prior Publication Data

US 2018/0227657 A1 Aug. 9, 2018

Related U.S. Application Data

(60) Provisional application No. 62/455,647, filed on Feb. 7, 2017.

(51) Int. Cl.

| | |
|---|---|
| ***D04B 1/22*** | (2006.01) |
| ***D04B 1/10*** | (2006.01) |
| ***D04B 7/32*** | (2006.01) |

(52) U.S. Cl.

CPC ..... *D04B 1/22* (2013.01); *D04B 1/102* (2013.01); *D04B 7/32* (2013.01)

(58) Field of Classification Search

CPC . D04B 1/102; D04B 1/22; D04B 7/18; D04B 7/30; D04B 7/32

See application file for complete search history.

(56) References Cited

U.S. PATENT DOCUMENTS 1,597,410 A * 8/1926 Hinchliff ..... D04B 1/24 66/171
2,405,326 A * 8/1946 Plotsky ..... A61F 11/06 2/209

(Continued)

FOREIGN PATENT DOCUMENTS

| | | | |
|---|---|---|---|
| FR | 744507 | A | 4/1933 |
| FR | 812746 | A | 5/1937 |
| GB | 1013784 | A | 12/1965 |

OTHER PUBLICATIONS

"Cat Ears Headphones Cover," (RAVELRY), available on Jun. 22, 2015; retrieved from https://www.ravelry.com/patterns/library/cat-ears-headphones-cover; retrieved on Mar. 31, 2018; all pages.

(Continued)

*Primary Examiner* — Danny Worrell

(74) *Attorney, Agent, or Firm* — Brooks Kushman, P.C.

(57) ABSTRACT

A seamless knit enclosure for a headphone unit is provided. The seamless knit enclosure may include a pair of earpieces and a headband spanning therebetween. The seamless knit enclosure may include a first region and a second region. The first region may have a stitch construction that has a first elasticity. The second region may have a second stitch construction that has a second elasticity that is different than the first.

14 Claims, 8 Drawing Sheets

(56) References Cited

U.S. PATENT DOCUMENTS

| | | | | | |
|---|---|---|---|---|---|
| 2,714,813 | A | | 8/1955 | Hill | |
| 3,184,758 | A | * | 5/1965 | Hirsch | A61F 11/06 2/209 |
| 3,727,659 | A | * | 4/1973 | Shuford | B65D 65/00 150/160 |
| 4,047,400 | A | * | 9/1977 | Thorneburg | A41D 20/00 66/171 |
| 4,499,741 | A | * | 2/1985 | Harris | A41D 20/00 2/162 |
| 4,514,995 | A | * | 5/1985 | Curtis | A47G 23/03 150/154 |
| 4,776,044 | A | * | 10/1988 | Makins | A42B 1/245 2/172 |
| 4,858,248 | A | * | 8/1989 | Goldsmith | A42B 1/245 2/209.13 |
| 4,864,619 | A | * | 9/1989 | Spates | H04R 1/10 381/309 |
| 5,038,412 | A | * | 8/1991 | Cionni | A41D 20/00 2/171 |
| 5,303,426 | A | * | 4/1994 | Jones | A41D 20/00 2/181 |
| 5,456,274 | A | * | 10/1995 | Selbee | A45D 8/00 132/275 |
| 5,625,903 | A | * | 5/1997 | Schultz | A61F 9/029 2/209 |
| 5,718,001 | A | * | 2/1998 | Wright | A45D 44/12 128/864 |
| 5,823,012 | A | * | 10/1998 | Hacskaylo | A41D 20/00 66/171 |
| 5,881,390 | A | * | 3/1999 | Young | A41D 20/00 2/209.13 |
| 5,927,296 | A | * | 7/1999 | Maturaporn | A45D 8/36 132/273 |
| 6,227,011 | B1 | * | 5/2001 | Cortinovis | A41D 20/00 2/171 |
| 6,711,749 | B2 | | 3/2004 | White et al. | |
| 6,888,950 | B2 | * | 5/2005 | Siskin | A61F 11/14 381/378 |
| 7,024,013 | B1 | * | 4/2006 | Van Dam | A61F 11/14 2/209 |
| 7,212,645 | B2 | * | 5/2007 | Le Gette | H04R 1/06 381/301 |
| 8,111,859 | B2 | * | 2/2012 | Phillips | H04R 5/0335 381/374 |
| 8,646,466 | B2 | * | 2/2014 | Howard | A45D 8/36 132/275 |
| 8,781,548 | B2 | * | 7/2014 | Besko | A61B 5/14553 600/310 |
| 9,154,866 | B2 | | 10/2015 | Bibl et al. | |
| 9,185,483 | B2 | | 11/2015 | Solomon et al. | |
| 9,259,046 | B2 | * | 2/2016 | Lee | A42B 1/245 |
| 9,854,348 | B2 | * | 12/2017 | Naylor-Warren | H04R 1/105 |
| 10,143,254 | B2 | * | 12/2018 | Hawes | A42B 1/245 |
| 2006/0185062 | A1 | * | 8/2006 | Peng | H04R 5/0335 2/209.13 |
| 2006/0207297 | A1 | * | 9/2006 | Tseng | D04B 1/18 66/202 |
| 2008/0163408 | A1 | * | 7/2008 | Tseng | D04B 1/18 2/336 |
| 2010/0284558 | A1 | | 11/2010 | Kimura et al. | |
| 2014/0126763 | A1 | | 5/2014 | Yoo | |
| 2014/0328508 | A1 | * | 11/2014 | Jacks | H04R 1/1008 381/376 |
| 2014/0366585 | A1 | | 12/2014 | Shen et al. | |
| 2016/0038803 | A1 | | 2/2016 | Burns et al. | |
| 2017/0118552 | A1 | * | 4/2017 | White | H04R 1/12 |

OTHER PUBLICATIONS

"NEFF the Staple Headphones by NEFF", Author Unknown, http://www.betterlivingthroughdesign.com/personal/neff-knit-headphones/, 2 pages.

* cited by examiner

SEAMLESS KNIT ENCLOSURE FOR HEADPHONES

CROSS-REFERENCE TO RELATED APPLICATIONS

This application claims the benefit of U.S. Provisional Application No. 62/455,647 filed Feb. 7, 2017, the disclosure of which is hereby incorporated in its entirety by reference herein.

TECHNICAL FIELD

The present disclosure relates to listening devices such as headphones that are designed to be worn on or around the head over a user's ears.

BACKGROUND

Headphones are designed to allow a single user to listen to an audio source privately, in contrast to a loudspeaker, which emits sound into the surrounding environment for anyone to hear. Headphones often include electroacoustic transducers which convert electrical signal to a corresponding sound in the user's ear. Headphones may include circular or ellipsoid ear pads that encompass or rest against the ears. The ear pads are typically connected to one another by a semi-rigid flexible spring-steel band e.g., headband, adapted to be placed on a user's head and a wire that electrically connects two or more speakers enclosed by the ear pads. The headband is typically curved and provides sufficient force to the ear pads to hold the headphones in place. The headphones may be adjustable so a user may change the position of the ear pads for comfort. The speakers, spring-steel band, wire, and other internal components are often enclosed plastic cover pieces that are fastened together by screws, glue, or a snap-fitting arrangement. The cover may include aesthetically pleasing ornamental designs.

SUMMARY

According to one embodiment of this disclosure, a seamless knit enclosure for a headphone unit is provided. The seamless knit enclosure may include a pair of earpieces and a headband spanning therebetween. The seamless knit enclosure may include a first region and a second region. The first region may have a stitch construction that has a first elasticity. The second region may have a second stitch construction that has a second elasticity that is different than the first.

The headband may define a longitudinal axis extending between the pair of earpieces. The first and second elasticity may be measured along the longitudinal axis.

Each of the earpieces may include a third region partially surrounding the second region. The third region may define a third elasticity equal to the first elasticity.

Each of the earpieces may include a fourth region that defines an elongated aperture extending along the longitudinal axis. The fourth region may be comprised of a fourth stitch construction that defines a fourth elasticity greater than the elasticity of the third region.

Each of the earpieces may include a fifth region including a fifth stitch construction that lies along at least one end of the elongated aperture. The fifth stitch construction may define a fifth elasticity that is greater than fourth elasticity of the fourth region.

The headband portion may include a sixth region comprised of a sixth stitch construction defining a sixth elasticity greater than the first elasticity.

Each of the earpieces may include a seventh region that is disposed between a distal end of each earpiece and the third region comprised of a seventh stitch construction defining a seventh elasticity equal to the second elasticity.

According to another embodiment of this disclosure, a seamless knit enclosure is provided. The seamless knit enclosure may include first and second earpieces. The first and second earpieces may include a first region comprised of a first stitch construction that defines a first elasticity. The headband portion may extend between the first and second earpieces. The headband portion may include a second region that is comprised of a second stitch construction that defines a second elasticity less than the first.

The headband portion may define a longitudinal axis extending between the first and second earpieces. The first and second elasticity is may be measured along the longitudinal axis.

The first stitch construction of the first region is may be arranged in an alternate tuck pattern. The first stitch construction may include an upwardly facing crown followed by an upwardly facing peak. The second stitch construction may include an upwardly facing peak followed by an upwardly facing crown. The third stitch construction may include a downwardly facing crown followed by a downwardly facing peak. The fourth stitch construction may include a downwardly facing peak followed by a downwardly facing crown.

The stitch construction of the second region is may be arranged in an alternate miss pattern. The alternate miss pattern may include a repeating pattern of a first stitch construction, a second stitch construction, a third stitch construction and a fourth stitch construction. Each of the threads may have a first end and a second end. The first stitch construction may include an upwardly facing crown disposed near the first end and the second stitch construction may include an upwardly facing crown disposed closer to the second end compared to the crown of the first stitch construction. The third stitch construction may include a downwardly facing crown disposed near the first end. The fourth stitch construction may include a downwardly facing crown disposed near the second end.

Each of the earpieces may include a third region partially surrounding the second region. The third region may define a third elasticity equal to the elasticity of the first region.

The stitch construction of the third region is may arranged in an alternate miss pattern. The alternate miss pattern of the third region may have a visual pattern different than a visual pattern defined by the second region. The third region may have a bird's eye visual pattern.

The stitch construction of the third region is may arranged in an alternate tuck pattern. The alternate tuck pattern may include a repeating pattern of a first stitch construction, second stitch construction, third stitch construction, fourth stitch construction, fifth stitch construction, and a sixth thread construction. The first stitch construction may include two upwardly facing stitches and an upwardly facing peak. The second stitch construction may include two downwardly facing threads and a downwardly facing peak. The third stitch construction may include an upwardly facing peak disposed between a first and second upwardly facing stitches. The fourth stitch construction may include a downwardly facing peak disposed between two downwardly facing stitches. The fifth thread may include an upwardly facing peak followed by two upwardly facing stitches. The sixth thread may include a downwardly facing peak followed by two downwardly facing stitches.

Each of the earpieces may include a fourth region that defines an elongated aperture extending along the longitudinal axis. The fourth region is may comprised of a fourth stitch construction that defines a fourth elasticity greater than the elasticity of the third region.

The fourth stitch construction may be arranged in a links links pattern. The links links pattern may include a repeating pattern of a first stitch construction, a second stitch construction, a third stitch construction and a fourth stitch construction. The first and second stitch constructions may include a plurality of downwardly facing stitches. The third and fourth stitch constructions may include a plurality of upwardly facing stitches.

Each of the first and second earpieces may include a fifth region disposed between the first and fourth regions and comprised of a fifth stitch construction. The fifth stitch construction may define a fifth elasticity that is measured along a direction transverse to the longitudinal axis. The elasticity of the fifth stitch construction is may at least greater than the elasticity of the fourth stitch construction.

The stitch construction of the fifth region is may arranged in a one by one stitch construction. The one by one stitch construction may be configured to facilitate a reduction in stress at a beginning and end of a split.

The one by one stitch construction may include a repeating pattern of a first stitch construction, a second stitch construction, a third stitch construction, and a fourth stitch construction. The first stitch construction may include three upwardly facing stitches and three downwardly facing stitches that are interstitially positioned between the upwardly facing stitches. The second stitch construction may include three upwardly facing stitches and three downwardly facing stitches that are interstitially positioned between the upwardly facing stitches. The third stitch construction may include three upwardly facing stitches and three downwardly facing stitches that are interstitially positioned between the upwardly facing stitches. The fourth stitch construction is may positioned below the third stitch construction and may include three upwardly facing stitches and three downwardly facing stitches. The three downwardly facing stitches may be interstitially positioned between the upwardly facing stitches.

The headband may also include a sixth region. The sixth region may be composed of a sixth stitch construction that defines a sixth elasticity. The sixth elasticity is may be measured along a direction that is transverse to the longitudinal axis. The sixth elasticity may be greater than the third elasticity.

The stitch construction of the sixth region is may arranged in an alternate miss pattern on every fourth needle. The alternate tuck on every fourth needle pattern may include a repeating pattern of a first stitch construction, second stitch construction, third stitch construction, fourth stitch construction, fifth thread, and sixth thread. The first stitch construction may include two upwardly facing stitches and an upwardly facing peak. The second stitch construction may include two downwardly facing threads and a downwardly facing peak. The third stitch construction may include an upwardly facing peak disposed between first and second upwardly facing stitches. The fourth stitch construction may include a downwardly facing peak disposed between two downwardly facing stitches. The fifth thread may include an upwardly facing peak followed by two upwardly facing stitches. The sixth thread may include a downwardly facing peak followed by two downwardly facing stitches.

Each of the first and second earpieces may include a seventh region. The seventh region is may disposed between distal ends of each earpiece and the third region. The seventh region may include a seventh stitch construction that defines seventh elasticity. The seventh elasticity may be equal to the second elasticity.

The stitch construction of the seventh region is may arranged in an alternate miss pattern. The alternate miss pattern is configured to conform to narrow towards at least one end of the first and second ear pieces.

DETAILED DESCRIPTION

Figure 1:
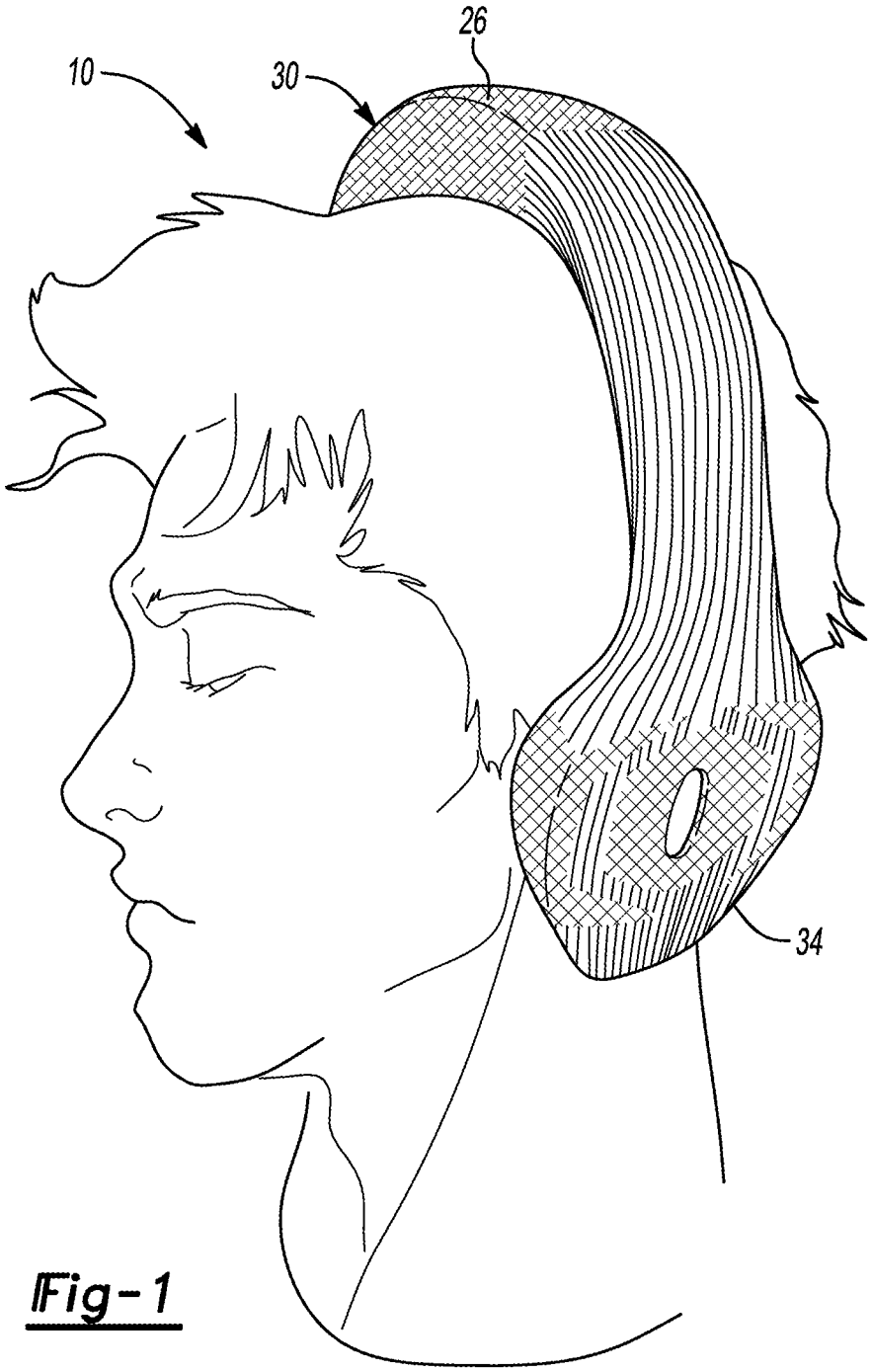
FIG. 1 illustrates a perspective view of the head phone enclosure according to at least one embodiment of this disclosure.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Headphones generally include multiple plastic pieces that make up an enclosure to cover and protect the electrical and structural components of a pair of headphones. Headphones may include circular or ellipsoid ear pads that encompass or rest against the ears. The ear pads are typically connected to one another by semi-rigid flexible spring-steel band, e.g., headband adapted to be placed on a user's head and wire electrically connecting at least two speakers each disposed adjacent to the ear pads. The use of plastic components often requires a certain thickness to maintain some structure to protect the spring-steel band, wires, and speakers. To fold the headphones, multiple plastic components must be separated to provide sufficient space or a hinge to bend the headphones into a collapsed position. Because plastic is used as the enclosure separate soft ear pads must be provided.

The disclosure recognizes the above issues and provides an approach to at least partially address it. The present disclosure relates to a seamless knit headphone enclosure and a method of making the same. The enclosure is may comprised of a single piece of fabric having a tubular construction. The headphone enclosure may provide sufficient rigidity in certain locations to maintain and hold the internal components of the headphone assembly together.

Other locations are flexible to allow the headphones to be folded into a compact shape. The varying rigidity and flexibility of the enclosure is accomplished by utilizing different stitch constructions offering corresponding elasticity. The headphone enclosure has a one-piece design thereby simplifying the assembly of the headphones. As an alternate embodiment, the headphone enclosure may be used as an accessory and act as an aesthetically pleasing cover for a conventional headphone assembly.

A seamless knit structure is often produced by what is referred to as a complete garment knitting process or three-dimensional (3D) knitting. As opposed to conventional knitting, that requires shaped pieces to be sewn together, 3D knitting machines utilize computerized instructions that direct movement of several needs to construct and connect several tubular knitted forms to create a complete garment in a single step. 3D knitting decreases wasted materials and eliminates several steps associated with conventional sewing.

3D knitting may be accomplished by various techniques, including but not limited to flat knitting, warp knitting, weft knitting and circular knitting. In one embodiment, the seamless headphone enclosure is may be produced by flat bed weft knitting. Flat bed weft knitting is a method that creates a knitted fabric by moving a number of feeders or vessels that carry the thread across a needle bed. As the needles within the needle bed move up and down to engage the thread, a loop is created. As multiple loops are created, the knitted structure is developed.

The amount of material generated is measured by wales per inch (WPI). The amount of WPI is dependent on the number of needles required to create an inch width of fabric. As one example, if a piece of fabric has a 50 WPI then 50 needles are required to create one inch. Another unit of measure related to knitted structure is course per inch (CPI). CPI refers to how many knitting rows required to create one inch of a knitted part. As one example, if a piece of fabric has a 100 CPI, then 100 knitting rows are required to complete one inch of knitting.

In one embodiment, flat bed differs from warp knitting, circular knitting, or weaving. Flat bed knitting facilitates the creation of more versatile, complex, and unique products with various materials in isolated areas. Conventional flat bed weft knitting typically has only two needle beds. The process used to create the headphone enclosure may have four needle beds. A variety of yarns may be utilized to create the headphone enclosure of one or more embodiments. In one embodiment, one feeder provides a double covered elastic yarn that has an elastane core covered in nylon. The other yarn may have a composition that is 83% nylon and 17% spandex by weight. In other embodiments the composition may include one of or a range of the following percentage of nylon, with the balance being spandex: 10%, 20%, 30%, 40%, 50%, 60%, 70%, 80%, by weight. In other embodiments the composition yarn may include a percentage of steel or carbon fiber by weight with the balance being either nylon or spandex.

In the following discussion of the figures, a polar coordinate system is utilized. A longitudinal axis extends along the headband between the earpieces of the headphone enclosure. A transverse axis extends orthogonal to the longitudinal axis.

The headphone enclosure may include at least seven regions, each comprising a stitch construction that is unique to each region. Each stitch construction provides a unique elasticity. Elasticity may refer to the ability of the region to resist distortion or deforming and its ability to retain or return to its original size and shape. Elasticity may be measured along the longitudinal or the transverse axis, or both. Mechanical strain is integrally related to elasticity. While elasticity refers to the property of solid material to return to its original shape and size after the force deforming it has been removed, strain refers to a change in some spatial dimension, e.g., length, angle or volume, compared to its original value.

Mechanical properties of a weft knitted structure may vary depending on the type of stitch or stitch construction utilized. The strain of a knitted structure refers to the percentage change in length in response to a constant force. A knit structure having a "low strain rate" or "low elasticity" may have a range between 1% and 11%. A knit structure having a "medium strain rate" or "medium elasticity" structure may have a range between 11% and 14%. A knit structure having a "high strain rate" or "high elasticity" may have a range between 14 and 20%.

Figure 2:
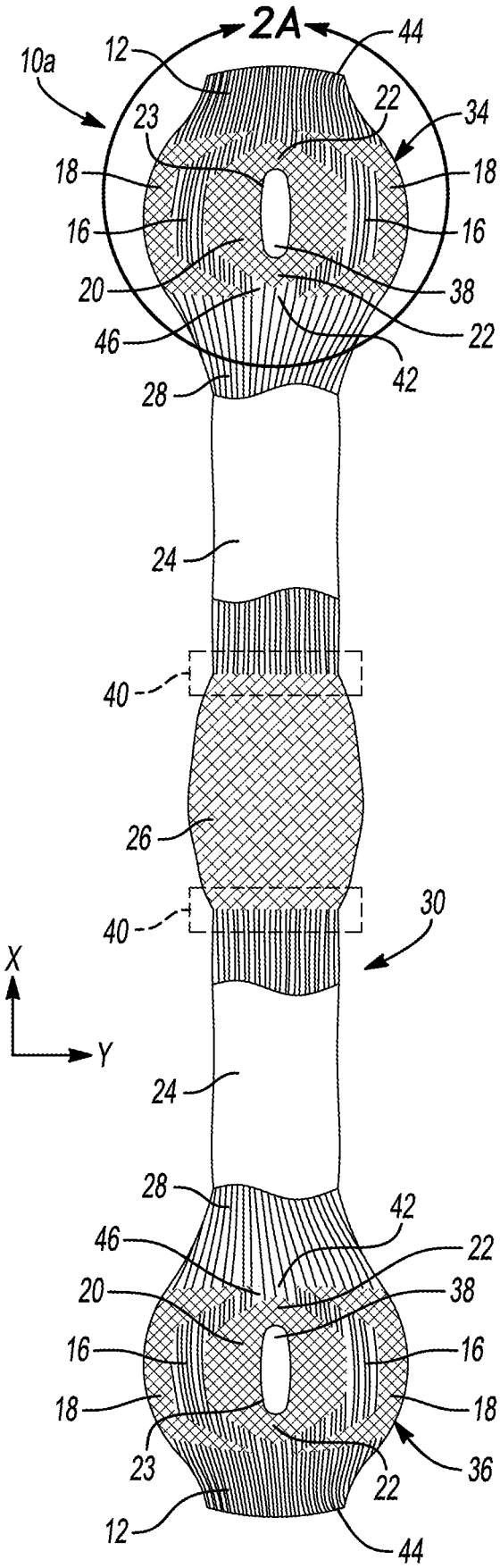
FIG. 2 illustrates a top view of the external surface of the headphone enclosure according to at least one embodiment.
Figure 3:
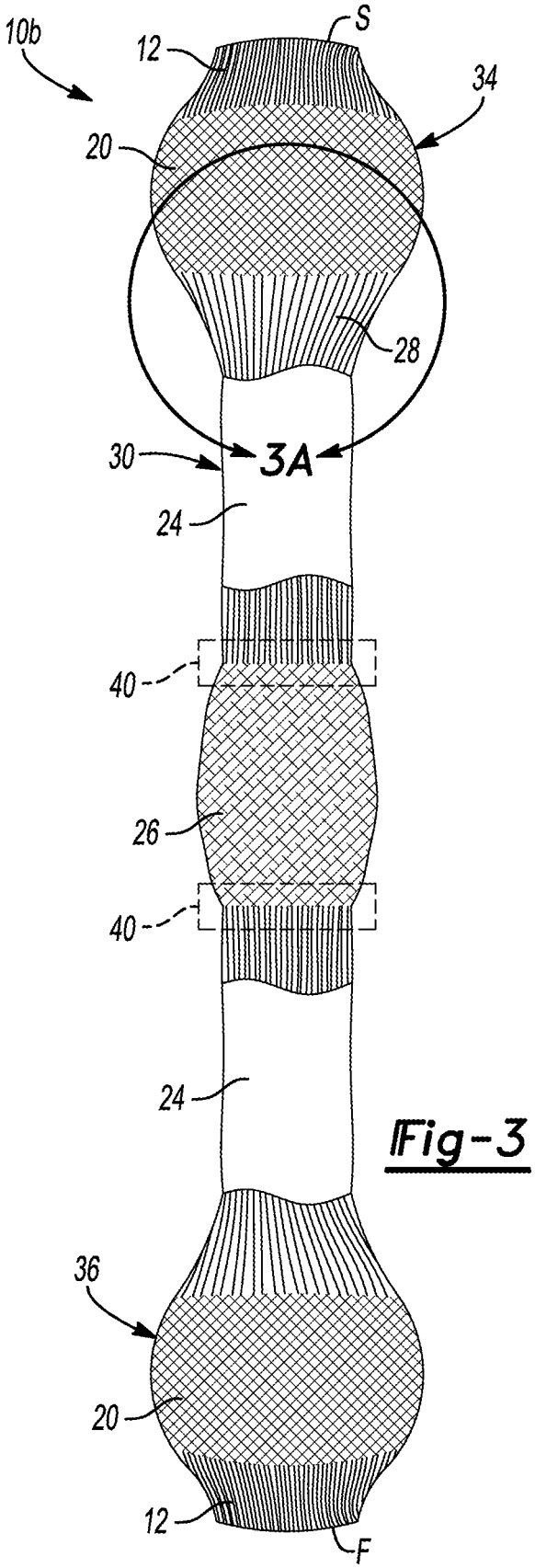
FIG. 3 illustrates a top view of the inner surface of the headphone enclosure according to at least one embodiment of this disclosure.
Figure 3A:
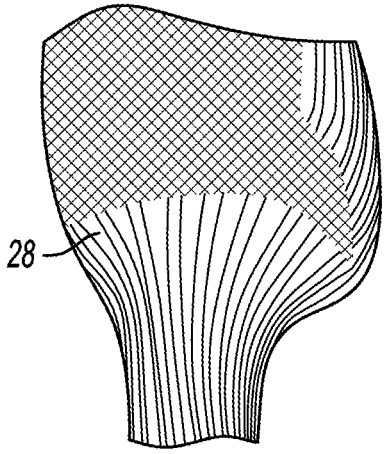
FIGS. 3A and 3B are detailed views of a portion of the external surface of the headphone enclosure according to at least one embodiment of this disclosure.
Figure 3B:
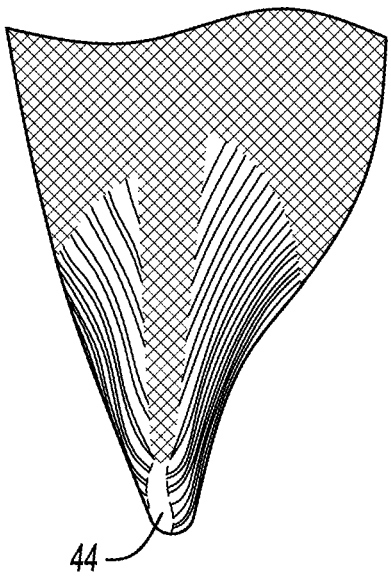

FIGS. 1 through 3 illustrate the location of each region according to at least one embodiment of this disclosure. FIGS. 4 through 11 illustrate the stitch construction used in each region. With the exception of the sixth region 26 the other regions are duplicated on either side of the sixth region 26. Between each region, a transition is provided. Because each region has a unique stitch construction, a transition region is required to connect the regions.

Referring to FIG. 1, a perspective view of a headphone unit that includes the seamless knit headphone enclosure 10 worn by a user is illustrated. The headphone enclosure 10 includes a pair of earpieces 34 36 (only one is illustrated) connected by a headband 30.

Referring to FIGS. 2-3, top views of an external side 10*a* and an inner side 10*b* of the headphone enclosure are illustrated. The external side 10*a* may be the side opposite of the inner side 10*b* that is adjacent to a user's head and ears during use. As mentioned above, the headphone enclosure 10 is comprised of seven regions according to one embodiment. Each region is comprised of a unique stitch construction or thread construction that provide aesthetic and structural characteristics. A first region 16 has a black and white lined pattern extending substantially parallel to the longitudinal axis. The first region 16 may be comprised of an alternate tuck thread structure. The alternate tuck thread structure provides a medium elasticity along the longitudinal and transverse axes.

A pair of second regions 24 make up a portion of the headband 30 that extend to the earpieces 34 36. The two second regions 24 are each comprised of an alternate miss pattern that only knits on every fourth needle. This thread structure provides a low elasticity as along the transverse axis and a medium elasticity along the longitudinal axis.

A third region 18 is disposed between the first region 16 and a portion of the outer periphery of each earpiece that extends along the direction of the longitudinal axis. Like the first regions 16, the third region 18 is comprised of an alternate tuck thread structure. As mentioned above, the alternate tuck thread structure provides a medium elasticity along the longitudinal and transverse axes. Despite having the same thread structure as the first region 16, the aesthetic pattern of the third region 18 differs from the first region in that it is a series of cross-hatched lines.

Each earpiece includes an aperture 38 that is sized to accommodate the insertion of a headphone assembly (not pictured). A fourth region 20 extends around the periphery of the aperture 38. The fourth region 20 is comprised of a links links stitch construction. The links links stitch construction provides maximum elasticity along the longitudinal and transverse axes. The maximum elasticity of the stitch construction facilitates the insertion of the headphones. Peripheral stitching 23 surrounding the aperture 38 is comprised of a thread structure made from C-Knitting. The peripheral stitching 23 will be explained in greater detail below.

A fifth region 22 is disposed between the first region and the fourth region. The fifth region 22 is comprised of a one by one rib stitch construction. Similar to the fourth region 20, the fifth region 22 provides maximum elasticity along the longitudinal and transverse axis. Again, the maximum elasticity of the stitch construction facilitates the insertion of the head phones.

The headband 30 may include a sixth region 26 and two second regions 24 disposed on either side of the sixth region 26. The sixth region 26 may have a black and white dotted pattern and the two second regions 24 have a black and white striped pattern that extend parallel to the longitudinal axis. The sixth region is comprised of an alternate tuck thread structure. The alternate tuck thread structure provides a medium elasticity along the longitudinal and transverse axes.

A seventh region 12 is disposed between the fifth region 22 and a portion of the outer periphery that is transverse to the longitudinal axis. The seventh region 12 has an aesthetic pattern of a series of alternating black and white lines that are substantially aligned parallel with the longitudinal axis. The seventh region is comprised of an alternate miss stitch construction. The alternate miss stitch construction provides a low elasticity along the transverse axis.

As mentioned above, a number of transitions are provided between the regions. A first transition 40 is provided between the second region 24 and the sixth region 26. The first transition 40 is used to create a half-gauge twill pattern that is consistent with the width and the drop required to fit the enclosure 10 on the headphone band. A second transition 42 is provided between the second region 24 and the fifth region 22. The second transition 42 facilitates the change between a full gauge construction to a half gauge construction. A third transition, is used throughout the seventh region 12. A fourth transition 44, forms the start, indicated by "s," and the end, indicated by "e" of the headphone enclosure 10. The fourth transition 44 as further shown in FIG. 2A, facilitates seamless movement of the needles inward to decrease the width of the knitting without creating any holes. A fifth transition 46, is provided between the single jersey construction of the first region 16 and the one by one rib construction of the fifth region 22.

Figure 2A:
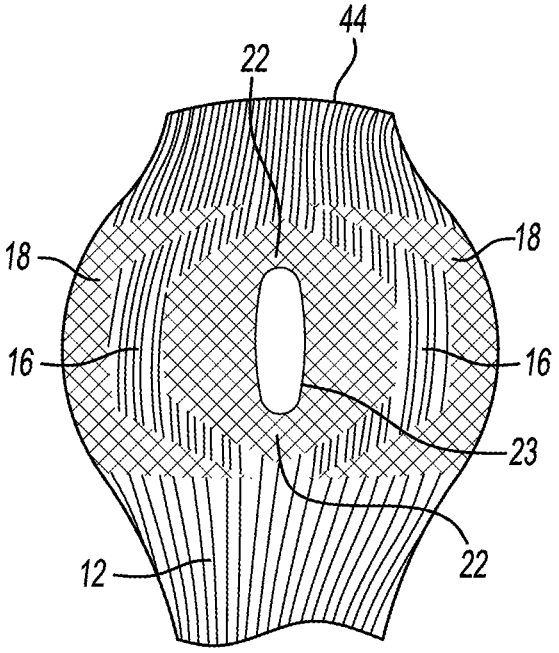
FIG. 2A is a detailed view of an earpiece and a portion of a headband of the headphone enclosure.

Referring FIG. 2A, the seventh region 12 extends between a portion of the outer periphery of the earpieces 34, 36 to the first region 16. The first region extends circumferentially around the fifth region 22. The third region 18 extends between a portion of the outer periphery of the earpieces and the first region 16. A second region 24 within the headband 30 is shown in FIG. 3D. The fourth region 20 has a links links stitch construction. Region 6B 28 is the transition between the second region 24 of the headband 30 and the earpieces 34 36.

FIG. 4 through FIG. 11 illustrate various stitch constructions created by the knitting process for each region. The lines represent needles on the needle bed of the 3D knitting machine. Four separate needle beds may be employed; a front upper bed 52, front lower bed 54, back lower bed 56, and back upper bed 58. The illustrations represent a repeating pattern of the four needle beds and the shape and pattern of the individual yarns. Each individual yarn is shown separately, i.e., not interwoven. Each yarn is labeled by its color. Black yarns are represented by a B and white yarns are represented by W. The strands are shown this way to illustrate the repeating pattern of the threads more clearly. Note numerous other colors and arrangement of colors are possible.

Figure 4:
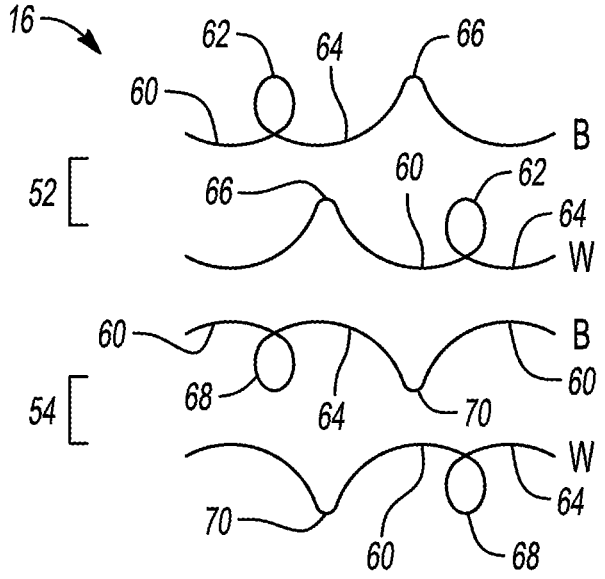
FIGS. 4-11 show various stitch constructions for each region of the headphone enclosure.

Referring to FIG. 4, an illustration of the stitch construction of the first region 16 is shown. The first region has an alternate tuck stitch construction. Despite looking similar to the seventh region 12 the thread structure here varies greatly from that in the seventh region 12. The top yarn on the front upper needle bed 52 has a first leg 60, an upwardly facing crown 62, a second leg 64 and a peak 66. The bottom yarn on the front upper needle bed 52, labeled W, has a peak 66, a first leg 60, a first upwardly facing crown 62, and a second leg 64. The top yarn on the front lower needle bed 54, labeled B, has a first leg 60, a downwardly facing crown 68, a second leg 64 that continues to a downwardly facing peak 70. The bottom yarn on the front lower bed 54, labeled W, has a downwardly facing peak 70, followed by a first leg 60, a downwardly facing crown 68 and a second leg 64. From the left to right, the stitches 62, 68 and peaks 66, 70 are substantially aligned with one another. The pattern mentioned above for the front upper bed 52 and the front lower bed 54 is identical to the pattern for the back lower bed 56 and back upper bed 58, and will not be repeated.

Figure 5:
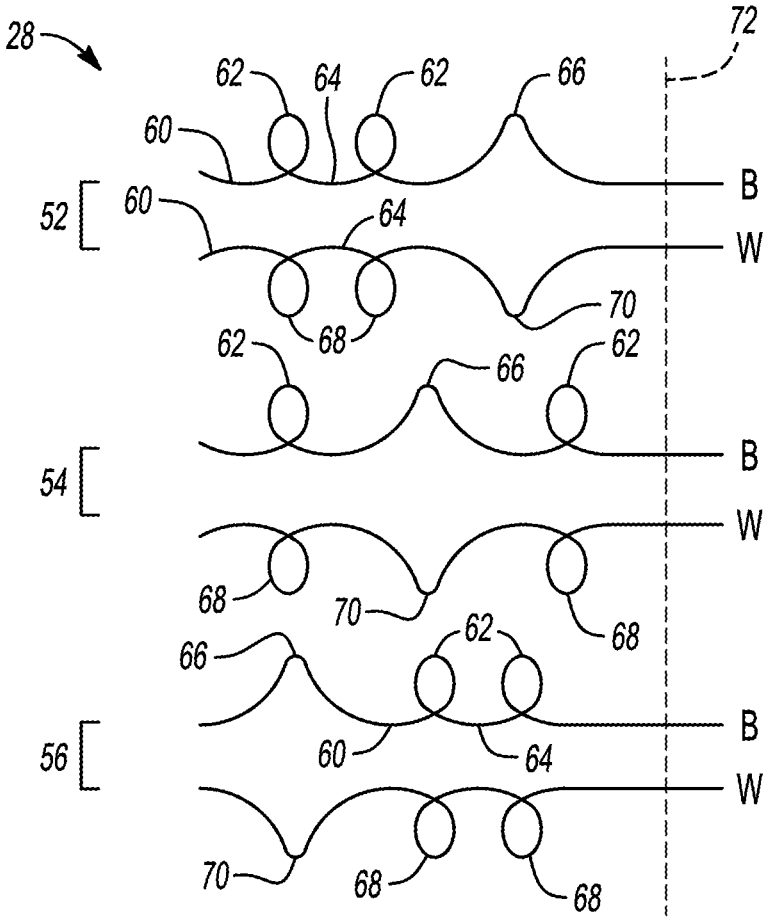

Referring to FIG. 5, an illustration of the stitch construction of the region 6B 28 is shown. The top yarn on the front upper needle bed 52, labeled B, may include a first leg 60, an upwardly facing crown 62, a second leg 64, another upwardly facing crown 62, followed by a peak 66 and an empty needle portion 72. The bottom yarn on the front upper needle bed 52, labeled W, includes a first leg 60, a downwardly facing crown 62, a second leg 64, another downwardly facing crown 62, followed by a downwardly facing peak 70, and an empty needle portion 72. The top yarn on the front lower needle bed 54, labeled B, includes a first leg 60, an upwardly facing crown 62, a second leg 64, a peak 66, another first leg 60, another upwardly facing crown 62, followed by a second leg 64, and ends with an empty needle portion 72. The bottom yarn on the front lower bed 54, labeled W, includes a first leg 60, a downwardly facing crown 68, followed by a second leg 64, a downwardly facing peak 70, a first leg 60, a downwardly facing crown 68, another second leg 64 that terminates into the empty needle portion 72. The top yarn on the back lower bed 56, labeled B, may include an upwardly facing peak 66, a first leg 60, an upwardly facing crown 62, a second leg 64, another upwardly facing crown 62, a second leg 64 that terminates into to an empty needle portion 72. The bottom yarn on the back lower bed 56, labeled, may include a downwardly facing peak 70, a first leg 60, a downwardly facing crown 68, a second leg 64, another downwardly facing crown 68, another second leg 64 that terminates into an empty needle portion 72. From right to left, the upwardly facing stitches 62 of the top yarn on the front upper needle bed 52 and the downwardly facing stitches 68 of the bottom yarn of the front upper needle bed 52 are substantially aligned with one another. Similarly, the upwardly facing peak 66 of the top yarn on the front upper needle bed 52 and the downwardly facing peak 70 of the bottom yarn on the front upper needle bed 52 are substantially aligned with one another from left to right. This pattern is repeated for the subsequent needle bed 56.

Figure 6:
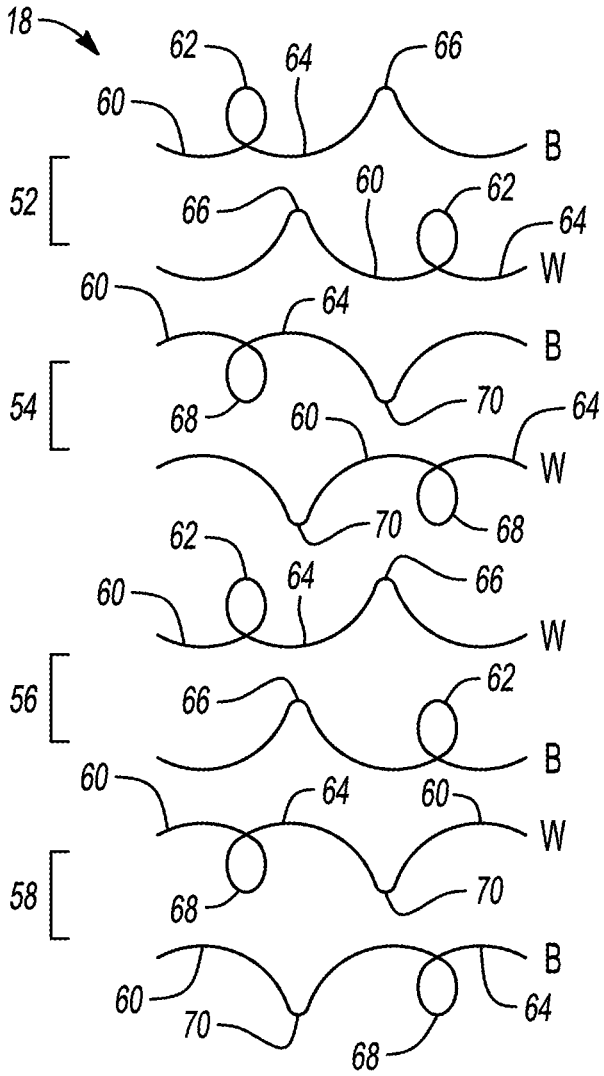

Referring to FIG. 6, an illustration of the stitch construction of the third region 18 is shown. The top yarn on the front upper needle bed 52, labeled B, may include a first leg 60, an upwardly facing crown 62, a second leg 64 and an upwardly facing peak 66. The bottom yarn on the upper needle bed 52, labeled W, may include an upwardly facing peak 66, a first leg 60, an upwardly facing crown 62, and a second leg 64. The top yarn on the front lower needle bed 54, labeled B, may include a first leg 60, a downwardly facing crown 68, a second leg 64 that continues to a downwardly facing peak 70. The bottom yarn on the front lower needle bed 54, labeled W, may include a downwardly facing peak 70, followed by a first leg 60, a downwardly facing crown 68 and a second leg. The top yarn on the back lower bed 56, labeled W, may include a first leg 60, an upwardly facing crown 62, a second leg 64 and an upwardly facing peak 66. The bottom yarn, labeled B, may include an upwardly facing peak 66, a first leg 60, an upwardly facing crown 62, and a second leg 64. The top yarn on the back upper bed 58, labeled W, may include a first leg 60, a downwardly facing crown 68, a second leg 64 that continues to a downwardly facing peak 70. The bottom yarn on the back upper bed 58, labeled B, may include a downwardly facing peak 70, followed by a first leg 60, a downwardly facing crown 68 and a second leg. From the left to right, the stitches 62, 68 and peaks 66, 70 are substantially aligned with one another.

Figure 7:
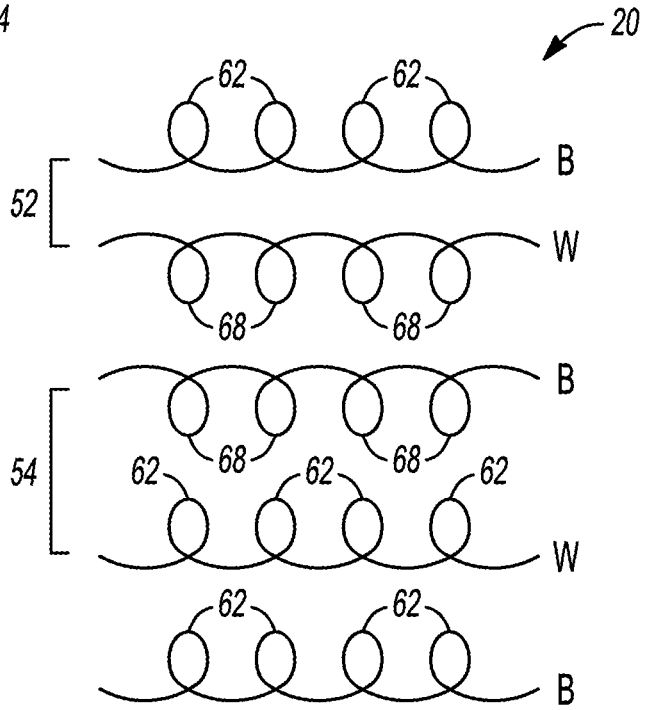

Referring to FIG. 7, an illustration of the stitch construction of the fourth region 20 is shown. The top yarn on the front upper needle bed, labeled B, may include four upwardly facing stitches 62. The top yarn on the front upper needle bed, labeled W, may include four downwardly facing stitches 68. The bottom yarn on the front upper needle bed, labeled B, includes four downwardly facing stitches 68. The top yarn on the front lower needle bed 54, labeled W, may include four upwardly facing stitches 62. The bottom yarn on the front lower needle bed 54 labeled B, may include four upwardly facing stitches 62. From left to right, the stitches 62, 68 are substantially aligned with one another.

Figure 8:
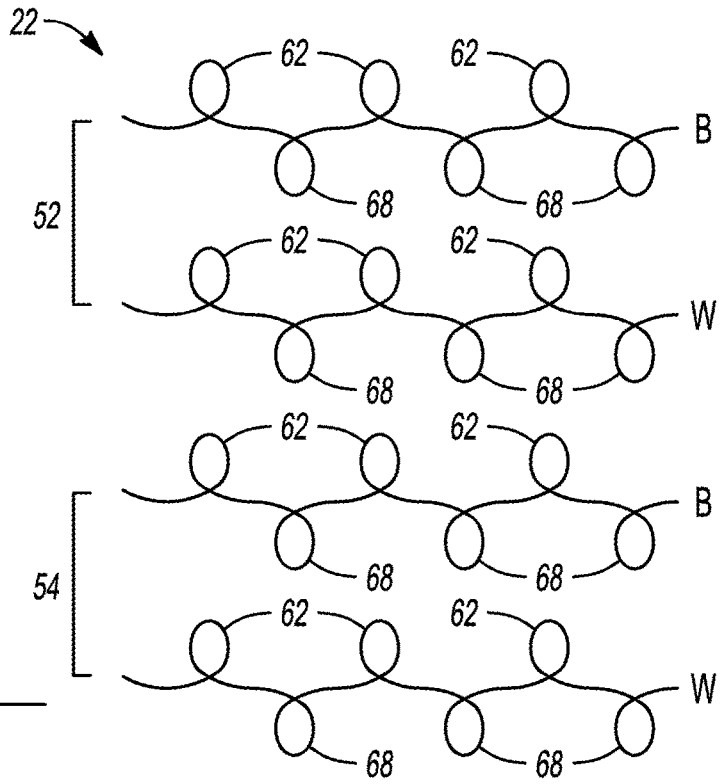

Referring to FIG. 8, an illustration of the stitch construction of the fifth region 22 is shown. The top yarn on the front upper needle bed 52, labeled B, may include three upwardly facing stitches 62 and three downwardly facing stitches 68 interstitially positioned between the upwardly facing stitches 62. The bottom yarn on the front upper needle bed 52, labeled W, may include three upwardly facing stitches 62 and three downwardly facing stitches 68 interstitially positioned between the upwardly facing stitches 62. The top yarn on the front lower need bed 54, labeled B, may include three upwardly facing stitches 62 and three downwardly facing stitches 68 interstitially positioned between the upwardly facing stitches 62. The bottom yarn on the front lower need bed 54, labeled B, may include three upwardly facing stitches 62 and three downwardly facing stitches 68 interstitially positioned between the upwardly facing stitches 62. From left to right, the upwardly facing stitches 62 of each yarn are substantially in line with one another. Similarly, the downwardly facing stitches 68 of each yarn are substantially aligned with one another.

Figure 9:
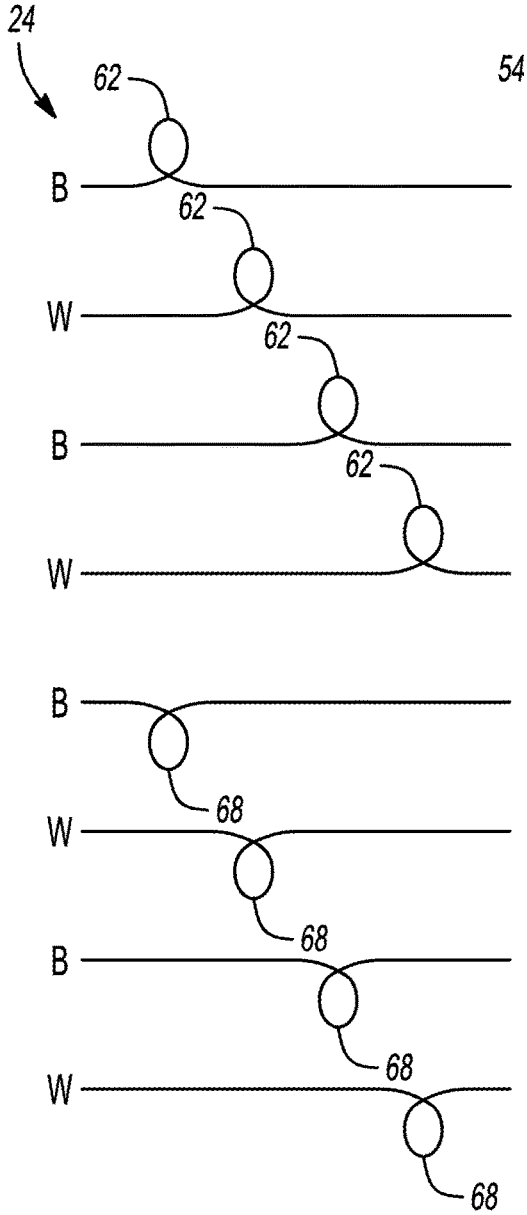

Referring to FIG. 9, an illustration of the stitch construction of the second region 24 is shown. From top to bottom, the first four yarns each have an upwardly facing crown 62. The upwardly facing stitches 62 are each positioned further to the right between the first and fourth stitch constructions. The last four yarns each have a downwardly facing crown 68. The downwardly facing stitches 68 are each positioned further to the right between the fifth through eighth yarns.

Figure 10:
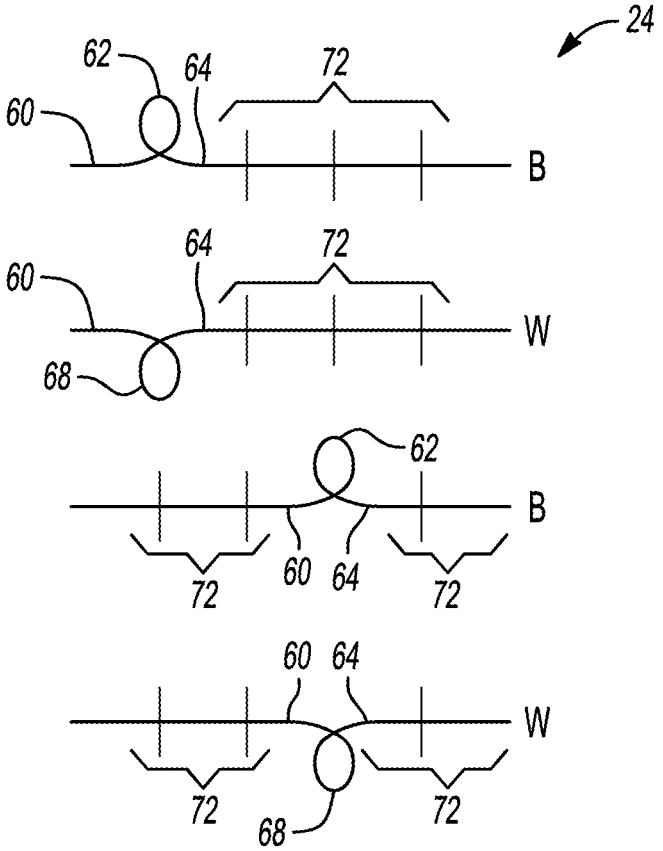

Referring to FIG. 10, an illustration of the stitch construction of the second region 24 is shown. The top yarn on the front upper needle bed 52, labeled B, may include a first leg 60, an upwardly facing crown 62, a second leg 64 that terminates into three empty needle portions 72. The bottom yarn on the front upper needle bed 52, labeled W, may include a first leg 60, a downwardly facing crown 68, a second leg 64 that terminates into three empty needle portions 72. The top yarn of the front lower bed 54, labeled B, may begin with two empty needle portions 72 and include a first leg 60, an upwardly facing crown 62, a second leg 64 that terminates into one empty needle portion 72. The bottom yarn of the front lower bed 54, labeled W, begins with two empty needle portions 72, followed by a first leg 60, a downwardly facing crown 68, a second leg 64 that terminates into an empty needle portion. From right to left, the upwardly facing crowns 62 and the downwardly facing crowns 68 are substantially aligned with one another.

Figure 11:
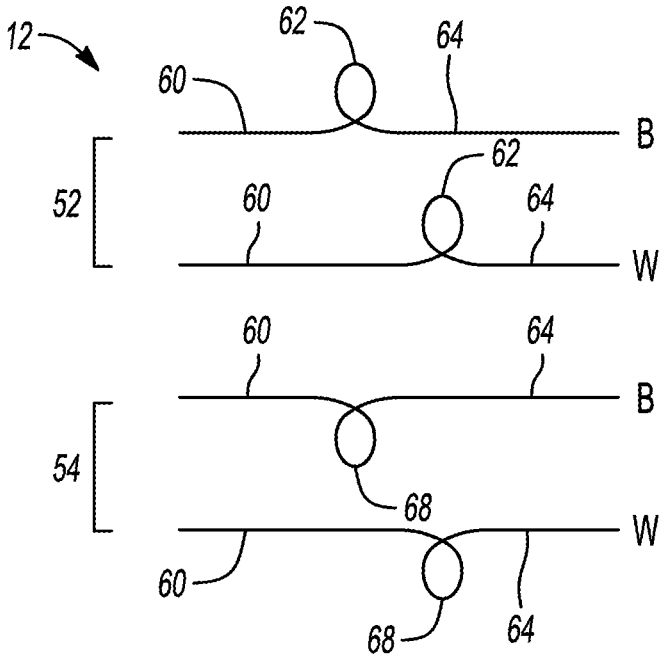

Referring to FIG. 11, an illustration of the stitch construction of the seventh region 12 is shown. The top yarn on the front upper needle bed 52, labeled B, may include a first leg 60, an upwardly facing crown 62, followed by a second leg 64. The bottom yarn on the front upper needle bed 52, labeled W, may include a first leg 60, an upwardly facing crown 60, followed by a second leg 64. The top yarn of the front lower bed 54, labeled B, may include a first leg 60, a downwardly facing crown 68, followed by a second leg 64. The bottom yarn of the front lower bed 54, labeled W, may include a first leg 60, a downwardly facing crown 68, followed by a second leg 64. From left to right, the upwardly facing crown 62 is substantially aligned with the downwardly facing crown 68. of the third stitch construction are substantially aligned with one another.

Figure 12:
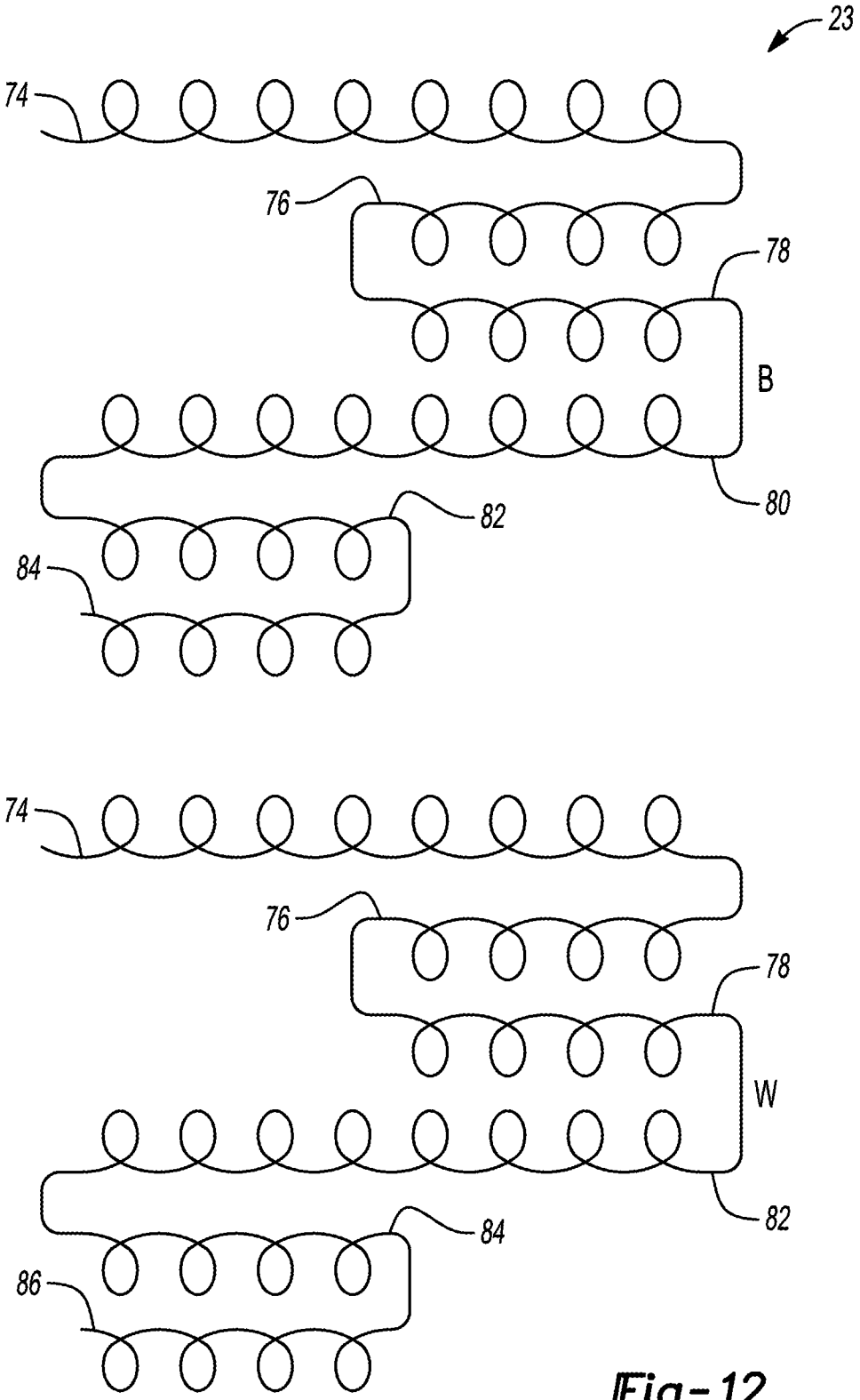
FIG. 12 illustrates a stitch construction for C-Knitting.

Referring to FIG. 12, an illustration of the knitted structure for the peripheral stitching 23 are shown. As previously mentioned, the peripheral stitching 23 surrounding the aperture 38 is produced by a C-Knitting method. C-Knitting utilizes the same needle bed in both directions in partial areas of the knitting width to create a uniform opening. The C-Knitting structure includes several portions utilizing upward facing stitches 62 and downwardly facing stitches 68. The first stitch construction in the top portion of the sketch is labeled, "black yarn." The first stitch construction is comprised of two longer portions 74, 80 and two shorter or partial portions 76, 78, disposed between the longer portions, and another pair of shorter or partial portions 82, 84. The second stitch construction situated below the first and labeled, "white yarn," has the same pattern as the first stitch construction.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A seamless knit enclosure for a headphone unit comprising:

a pair of earpieces and a headband spanning therebetween;

a first region including a first stitch construction having a first elasticity;

a second region including a second stitch construction having a second elasticity that is different than the first, a third region defined by each of the earpieces that lies along the second region and defines a third elasticity equal to the first elasticity; and a fourth region defined by each of the earpieces including a fourth stitch construction that defines an elongated aperture extending along a length of the enclosure and wherein the fourth stitch construction defines a fourth elasticity that is greater than the third elasticity.

2. The seamless knit enclosure of claim 1, wherein the headband defines a longitudinal axis extending between the pair of earpieces and wherein the first elasticity and the second elasticity are measured along the longitudinal axis.

3. The seamless knit enclosure of claim 1, further comprising:

a fifth region defined by each of the earpieces, including a fifth stitch construction, that lies along and is in contact with at least one end of the elongated aperture wherein the fifth stitch construction defines a fifth elasticity that is greater than the fourth elasticity.

4. The seamless knit enclosure of claim 3, further comprising:

a sixth region defined by the headband including a sixth stitch construction that defines a sixth elasticity that is greater than the first elasticity.

5. The seamless knit enclosure of claim 4, further comprising:

a seventh region, defined by a distal end portion of each of the earpieces, including a seventh stitch construction that defines a seventh elasticity that is equal to the second elasticity.

6. A seamless knit enclosure for a headphone assembly comprising:

a first earpiece and a second earpiece each configured to receive a speaker of the headphone assembly; and a headband spanning between the first and second earpieces and configured to receive a band of the headphone assembly, wherein the first and second earpieces each define a first region that includes a first stitch construction that defines a first elasticity and headband defines a second region that is comprised of a second stitch construction that defines a second elasticity that is less than the first, wherein the first stitch construction includes a repeating pattern of a first stitch, a second stitch, a third stitch, and a fourth stitch wherein, the first stitch is arranged to have an upwardly facing crown followed by an upwardly facing peak, the second stitch is arranged to have an upwardly facing peak followed by an upwardly facing crown, the third stitch is arranged to have a downwardly facing crown followed by a downwardly facing peak, and the fourth stitch is arranged to have a downwardly facing peak followed by a downwardly facing crown.

7. The seamless knit enclosure of claim 6, wherein each of the earpieces include a third region, at least partially surrounding the second region, that includes a third stitch construction defining a third elasticity that is equal to the first elasticity.

8. The seamless knit enclosure of claim 7, wherein the third stitch construction includes a plurality of stitches arranged in a visual pattern that is different than a visual pattern defined by the second stitch construction.

9. The seamless knit enclosure of claim 8, further comprising:

a fourth region defined by each of the earpieces including a fourth stitch construction that defines an elongated aperture extending along a length of the enclosure and wherein the fourth stitch construction is arranged in a links links pattern.

10. A seamless knit enclosure for a headphone unit comprising:

a first earpiece and a second earpiece each configured to enclose a speaker of the headphone unit and each defining a first region that includes a first stitch construction having a first-longitudinal elasticity and a first-transverse elasticity; and an elongated headband extending between the first earpiece and the second earpiece and defining a longitudinal axis wherein the elongated headband defines a second region that includes a second stitch construction having a second-longitudinal elasticity and a second-transverse elasticity that is different than the first-transverse elasticity, wherein each of the earpieces define an aperture that defines an inner periphery that includes a first yarn and a second yarn arranged in a repeating C-Knitting pattern.

11. The seamless knit enclosure of claim 10, wherein the first stitch construction is comprised of a plurality of stitches arranged in a one-by-one rib construction.

12. The seamless knit enclosure of claim 10, wherein the second-transverse elasticity is measured along a direction that is transverse to the longitudinal axis defined by the headband and wherein second-transverse elasticity is less than the first-transverse elasticity.

13. The seamless knit enclosure of claim 10, wherein the second stitch construction is comprised of a plurality of stitches arranged in an alternate tuck pattern.

14. The seamless knit enclosure of claim 10, further comprising:

a third region that includes a third stitch construction having a third-longitudinal elasticity and a third-transverse elasticity that is equal to the third-longitudinal elasticity.

* * * * *